United States Patent [19]

Nelson, Jr. et al.

[11] Patent Number: 4,846,847

[45] Date of Patent: Jul. 11, 1989

[54] ANTIGEL FUEL COMPOSITION

[75] Inventors: Otis L. Nelson, Jr.; Mark L. Nelson, both of Bay City, Mich.

[73] Assignee: Polar Molecular Corp., Saginaw, Mich.

[21] Appl. No.: 51,737

[22] Filed: May 18, 1987

Related U.S. Application Data

[63] Continuation-in-part of Ser. No. 901,015, Aug. 28, 1986, Pat. No. 4,673,411, which is a continuation of Ser. No. 569,441, Jan. 9, 1984, abandoned.

[51] Int. Cl.[4] ..... C10L 1/02

[52] U.S. Cl. ..... 44/53; 44/54; 44/57; 44/62; 44/77; 252/55; 252/351

[58] Field of Search ..... 44/51, 53, 54, 57, 62, 44/77; 252/55, 351; 585/14

[56] References Cited

U.S. PATENT DOCUMENTS

| | | | |
|---|---|---|---|
| 1,863,004 | 6/1932 | Burwell | 252/55 |
| 1,986,645 | 1/1935 | Prutton | 252/58 |
| 1,986,651 | 1/1935 | Prutton | 252/58 |
| 2,096,390 | 10/1937 | Burwell | 252/55 |
| 2,170,644 | 8/1939 | Nelson | 252/351 |
| 2,233,683 | 3/1941 | Smith | 252/56 |
| 2,672,450 | 3/1954 | Pearsall | 44/58 |
| 2,914,479 | 11/1959 | Tom et al. | 44/77 |
| 2,942,588 | 6/1960 | Rudel et al. | 252/58 X |
| 3,282,843 | 11/1966 | Alburger | 252/351 |
| 3,577,340 | 5/1971 | Paviak et al. | 252/351 |
| 3,658,494 | 4/1972 | Dorer, Jr. | 44/77 |
| 3,917,537 | 11/1975 | Elsdon | 44/53 |
| 4,365,973 | 12/1982 | Irish | 44/57 |
| 4,378,973 | 4/1983 | Sweeney | 44/57 |

OTHER PUBLICATIONS

Hawley, G. G., "The Condensed Chemical Dictionary", 10th Edition, p. 37, Alox, 1981.

*Primary Examiner*—William R. Dixon, Jr.
*Assistant Examiner*—Margaret B. Medley
*Attorney, Agent, or Firm*—Lackenbach, Siegel, Marzullo & Aronson

[57] ABSTRACT

An antigel composition for hydrocarbon fuels for combustion in motors, engines, turbines, and furnaces comprises:

(a) a polar oxygenated long chain hydrocarbon having a defined acid number, a defined saponification number, and a defined molecular weight;

(b) a low molecular weight addition polymer or copolymer, preferably of ethylene and vinyl acetate;

(c) optionally, a hydrophilic conditioner, selected from the group consisting of glycols, glycol diether, and half ethers preferably a methyl half ether of a glycol; and (d) optionally, a compatibilizing agent, preferably having a solubility parameter from about 8.8 to about 11.5, more preferably an alcohol having from 4 to 13 carbon atoms.

14 Claims, No Drawings

ANTIGEL FUEL COMPOSITION

CROSS REFERENCE TO PRIOR APPLICATIONS

This application is a continuation-in-part application of U.S. patent application Ser. No. 901,015, filed Aug. 28, 1986, now U.S. Pat. No. 4,673,411 issued June 16, 1987, which in turn is a continuation application of U.S. patent application Ser. No. 569,441, filed Jan. 9, 1984, and now abandoned.

FIELD OF THE INVENTION

This invention relates to antigel compositions for predominantly liquid hydrocarbon fuels for engines, turbines, and furnaces such as diesel fuel, heating oils, furnace fuel, jet aviation fuel, and motor fuels which may be stored or used at low temperatures.

BACKGROUND AND DISCUSSION OF THE PRIOR ART

The transport, storage, and feed of fuel oil for engines and furnaces presents many problems such as avoiding condensed water, foreign particles, bacteria, oxidation, corrosion products, and cold temperature. Low temperature can cause opacity due to separation of dissolved water into droplets, formation of a separate heavier layer, formation of ice particles, and separation of wax from the liquid hydrocarbon. Ideally the fuel oil should be a one-phase liquid, even during winter storage, but at low temperatures as many as four phases may be present (not counting foreign matter): oil/wax/water/ice.

Pearsall in U.S. Pat. No. 2,672,450 disclosed a composition for removing deposits from internal combustion engines comprising an alkyl-substituted benzene, a fatty acid ester such as methyl ricinoleate, and an alkyl ether of an ethylene glycol.

Tom et al. in U.S. Pat. No. 2,914,479 disclosed an upper cylinder lubricant and tune-up solvent comprising an aromatic oil extract, an ethylene glycol ether, a dilinoleic acid solution, and a chlorinated wax or acrylic polymer.

Kirk et al. in U.S. Pat. No. 3,250,599 have disclosed a microcrystalline wax or a copolymer of ethylene and vinyl acetate for improving the pumpability of oil.

Dorer et al. in U.S. Pat. No. 3,658,494 have disclosed a combination of a glycol ether and a dispersant as an aid to keeping internal combustion engines clean by incorporation in the fuel.

Elsdon in U.S. Pat. No. 3,917,537 disclosed a penetrating oil comprising lubricating oil, gasoline, an alcohol, and one or more glycols or glycol ethers.

Irish in U.S. Pat. No. 4,365,973 disclosed a combination of an ethylene-vinyl acetate copolymer, an organic nitrate, an aromatic solvent, and an alcohol for improving the cold flow properties of middle distillate fuels.

Sweeney in U.S. Pat. No. 4,378,973 disclosed a combination of cyclohexane and an oxygenated organic compound as an additive for lessening the smoke, soot, and invisible particulates emitted from the burning of diesel fuel.

OBJECTS OF THE INVENTION

It is an object of the present invention to prevent the formation of wax particles, as evidenced by the plugging of fuel filters, when predominantly hydrocarbon fuels are stored, transported, or used at cold temperatures.

It is a further object of the present invention to improve the cold flow properties of fuel in cold weather, so that the use of expensive diluents of lower fuel value is obviated.

It is yet a further object of the present invention to aid the formation of colloidal droplets of fuel oil which increases the heat produced by combustion, lowers the production of incompletely burned pollutants, and keeps atomizers and injectors clean.

It is still a further object of the present invention to keep any water in fuel dispersed, which eliminates the need for a drier, inhibits bacteria and corrosion, lowers acid formation, thus decreasing detritus, rust, and other foreign particles.

It is an additional object of the present invention to enable the user to burn heavier grades of fuel oil such as heavy gas oil (No. 4) and (No. 3), rather than the more expensive kerosene or light gas oil.

SUMMARY OF THE INVENTION

These and other objects of the invention known to those skilled in the art are attained by adding to the predominantly hydrocarbon fuels for engines, turbines, and furnaces the antigel composition of the present invention.

A principal component of the antigel combination is a polar, oxygenated, long chain hydrocarbon having a defined acid number, a defined saponification number, and a defined molecular weight. This oxygenated hydrocarbon is preferably made by the catalyzed, air oxidation of a petroleum fraction at elevated temperatures.

Another principal component of the antigel of the present invention is a low molecular weight, addition polymer or copolymer. Copolymers of ethylene and vinyl acetate are particularly preferred.

Without limiting this disclosure by hypothesis, it is believed that the role of both the polar, oxygenated hydrocarbon and the low molecular weight, addition polymer or copolymer is to inhibit growth of and/or disperse particles of wax.

More particularly, it is believed that the addition copolymer prevents large wax crystals from forming and the polar oxygenated hydrocarbon keeps small waxy particles dispersed.

It has been found that although each of the above principal components are useful alone, the combination of the polar oxygenated hydrocarbon and the low molecular weight addition polymer makes a particularly effective antigel composition.

An additional, optional, but useful component of the antigel composition of the present invention is a hydrophilic conditioner, which, by belief, functions to prevent large amounts of water from being incorporated into the fuel, especially on storage, thus improving combustion. Suitable separating agents for practicing the present invention are ethers of glycols or polyglycols, especially monoethers. A preferred hydrophilic conditioner is diethylene glycol monomethyl ether.

Another optional but useful component of the antigel composition is a compatibilizing agent. A suitable compatibilizing agent has a solubility parameter based on cohesive energy density, between about 8.8 to about 11.5. Alcohols having between four to 13 carbon atoms are the preferred compatibilizing agent, which helps maintain a potentially four-phase system: oil, wax, water, ice in one homogeneous phase, and/or aids in dispersing the composition of the present invention.

Considering the possible broad ranges of fuels, engines, furnaces, uses and temperature almost any ratio of the one-, two-, three-, or four-component embodiments of the antigel composition of the present invention may be useful. One representative illustration of a four-component composition is:

| Component | Wgt % |
|---|---|
| polar oxygenated hydrocarbon | 40 |
| ethylene/vinyl acetate copolymer | 40 |
| diethylene glycol monomethyl ether | 10 |
| decanol | 10 |

DETAILED DESCRIPTION OF THE INVENTION

The present invention is broadly applicable for preventing phase separation for a wide variety of fuels for a wide variety of engines, turbines, motors, or furnaces at a wide temperature range. The main purposes of the antigel composition of the present invention are to keep wax particles from precipitating from the oil and to keep small amounts of dispersed water from freezing as ice particles. Once too much water is present, then it is preferable that water settle out as a separate phase rather than remain dispersed in the oil, where it may interfere with some combustions. It is well known that under some conditions low concentrations of water aids combustion, however.

Generally the fuels of the present invention are hydrocarbons, but appreciable amounts of methanol, ethanol, isopropyl alcohol, or other oxygenated organics such as ethers or ketones may be present. The hydrocarbons may range from the crude oil or heavy fuel oils (No. 5 or 6) through the middle distillates such as heavy gas oil (No. 4), heating oil (No. 2 or No. 3), diesel fuel to light gas oil, or kerosene. Typically No. 2 heating oil or diesel fuel are preferred.

The fuel containing the antigel composition of the present invention may be stored, transported, and used for diesel engines, furnaces, aircraft jet engines, peak power jet engines, turbines, internal combustion engines, inboard marine engines, locomotives, trucks, military tanks, automobiles or any other type of machine which employs predominantly liquid hydrocarbon fuel, especially diesel fuel, No. 1, or No. 2 oil.

The usual hydrocarbon fuels of commerce are one-phase systems at ambient temperatures down to about 0° F. (−18° C.). Depending on the type of fuel, history of the sample, and the amount of exposure to water or ambient air, continued cooling can generate dispersed water droplets, a water layer, colloidal wax, or a mass of waxy particles. A wide variety of standard tests may be employed to measure this heterogeneity of phase, including but not limited to: cloud point (ASTM D2500), pour point (ASTM D97), solid remaining after distillation (ASTM D86) gravity (ASTM D287) and empirical methods of testing for flow or plugging of various size filters, such as 5 micron or 10 micron. There are also a large number of specifications for a wide variety of fuels, as illustrated by specifications for No. 2 fuel (ASTM D975).

The polar oxygenated hydrocarbons of the present invention are commercially made by the catalyzed air oxidation of various petroleum liquids. Often this oxidation is carried out at temperatures from about 125° C. to about 175° C. with an organometallic catalyst such as an ester of manganese, copper, iron, cobalt, nickel, or tin. A melange of polar, oxygenated compounds results containing mixtures of acids, hydroxy acids, lactones, esters, ketones, alcohols, anhydrides, and other oxygenated organic entities. Those suitable for the present invention are compounds and mixtures with an average molecular weight between about 250 and about 500, with an acid number (ASTM D974) between about 25 and about 100, and a saponification number (ASTM D974-52) from about 30 to about 250. Preferably the polar oxygenated component of the instant invention has an acid number from about 50 to about 125 and a saponification number from about 75 to about 200.

Without being limited by the imperfect understanding of a complex system, one can envision the polar oxygenated component fulfilling many functions in the context of the present invention. It may coat the incipient wax particles with the fatty portion of the molecule, leaving the polar part dangling to disperse the wax by coulombic repulsion. It may coat the metal of the furnace or engine parts with the polar portion, leaving the fatty portion hanging to lubricate the part. It may bridge the oil/water interface at a molecular or domain level to keep any water dispersed in the oil. It may prevent the formation of ice particles in supercooled water. In any case, what is known is that the polar oxygenated hydrocarbon functions as an antigelling agent.

The low molecular weight addition polymer apparently serves the same general colloidal functions just given above for the polar oxygenated hydrocarbon. Apparently the reason why a copolymer of ethylene and vinyl acetate is the preferred low molecular weight polymer is derived from the polarity in the ester groups of the acetate moiety being just enough compared to the nonpolarity of the hydrocarbon backbone of the polymer to give the copolymer the correct functional balance. No particular ethylene/vinyl acetate ratio is crucial. The copolymer may vary from 95/5 to 5/95 in weight percent ratio of the two monomers. For ethylene one may substitute propylene, butene, isobutylene, styrene, methylstyrene, or any other hydrocarbon addition monomer or their mixtures. In place of vinyl acetate one may substitute vinyl propionate, vinyl butyrate, methyl acrylate, ethyl acrylate, acrylamide, N-methylacrylamide, or any other slightly polar addition monomer or their mixtures. Styrene/maleic anhydride or other slightly polar copolymers may also be useful. Preferably the molecular weight of the addition polymer is between about 1,000 and about 3,000, but a wider range of molecular weight between about 500 to about 30,000 is useful depending on the homopolymer or copolymer chosen and the amount of such addition polymer used.

Although the addition polymer may function as an antigelling agent along, its combination with the polar oxygenated hydrocarbon yields far superior results, i.e. synergism.

The optional hydrophilic conditioner of the present invention may be a glycol monoether, or a glycol diether, but glycol monoethers are preferred. Its use is optional but preferred.

Examples of such compounds which may be used are the mononethers of ethylene glycol, propylene glycol, trimethylene glycol, alpha-butylene glycol, 1,3-butanediol, beta-butylene glycol, isobutylene glycol, tetramethylene glycol, hexylene glycol, diethylene glycol, dipropylene glycol, tripropylene glycol, triethylene glycol, tetraethylene glycol, 1,5-pentanediol, 2-methyl-2-ethyl-1, 3-propanediol, 2-ethyl-1, 3-hexanediol. Some monoethers include ethylene glycol monophenyl ether, ethylene glycol monomethyl ether, ethylene glycol monopropyl ether, ethylene glycol monoethyl ether, ethylene glycol mono-(n-butyl) ether, diethylene glycol monomethyl ether, diethylene glycol monoethyl ether, diethylene glycol mono-(n-butyl) ether, propylene glycol monomethyl ether, dipropylene glycol monomethyl ether, diethylene glycol monocyclohexyl ether, ethylene glycol monobenzyl ether, triethylene glycol monophenyl ether, butylene glycol mono (p-(n-butoxy) phenyl) ether, trimethylene glycol mono(alkylphenyl) ether, tripropylene glycol monomethyl ether, ethylene glycol monoisopropyl ether, ethylene glycol monoisobutyl ether, ethylene glycol monohexyl ether, triethylene glycol monobutyl ether, triethylene glycol monomethyl ether, triethylene glycol monoethyl ether, 1-butoxyethoxy -2-propanol, monophenyl ether of polyproplylene glycol having an average molecular weight of about 975–1075, and monophenyl ether of polypropylene glycol wherein the polyglycol has an average molecular weight of about 400–450 monophenyl ether of polypropylene glycol wherein the polypropylene glycol has an average molecular weight of 975–1075. Such compounds are sold commercially under trade names such as Butyl CELLOSOLVE, Ethyl CELLOSOLVE, Hexyl CELLOSOLVE, Methyl CARBITOL, Butyl CARBITOL, DOWANOL Glycol ethers, and the like.

Another optional component in the antigelling composition of the current invention is a compatibilizing agent.

Suitable compatabilizing agents of the instant invention are organic compounds of fairly high solubility parameter and strong hydrogen-bonding capacity. Solubility parameters, $\delta$, based on cohesive energy density are a fundamental descriptor of an organic solvent giving a measure of its polarity. Simple aliphatic molecules of low polarity have low $\nu$ of about 7.3; highly polar water has a high $\delta$ of 23.4. Solubility parameters, however, are just a first approximation to the polarity of an organic solvent. Also important to generalized polarity, and hence solvent power, are dipole moment and hydrogen-bonding capacity. Symmetrical carbon tetrachloride and some aromatics with low gross dipole moment and poor hydrogen-bonding capacity have a solubility parameter of about 8.5. In contrast, methyl propyl ketone has almost the same solubility parameter, 8.7, but quite strong hydrogen-bonding capacity and a definite dipole moment. Thus, no one figure of merit describes the "polarity" of an organic solvent.

For the practice of the present invention a compatibilizing agent should have a solubility parameter from about 8.8 to about 11.5 and moderate to strong hydrogen-bonding capacity. Suitable classes of organic solvents are alcohols, ketone, esters, and ethers. Preferred compatibilizing agents are straight-chain, branched-chain, and alicyclic alcohols with from four to 13 carbon atoms. Especially preferred compounds for compatibilizing agents are the hexanols, the decanols, and the dodecanols.

The compatibilizing agent of the present invention has a more complex function than the "drying" action which the hydrophilic conditioner is thought to have. Without being held to theory, it is believed that the compatibilizer keeps waxy particles and water dissolved in the oil phase rather than drawing water into the oil phase, since most of the favored compatibilizers are insoluble in water.

For several reasons the relative proportions of the four possible components in the antigel of the present invention may vary widely. Firstly, the hydrophilic conditioner and the compatibilizer are optional components, and only the polar oxygenated hydrocarbon or the low molecular weight addition polymer are necessary to the present invention. Secondly, a wide variety of fuels for a large number of different types of engines, motors, turbines, or furnaces may be protected by the antigel of the present invention. Thirdly, temperature can vary widely from place to place, season to season, and year to year during the same season. Hence, a myriad of compositional ratios are useful and operational.

The simplest antigel of the present invention comprises only the polar oxygenated hydrocarbon. Equally simple is an antigel comprising only the low molecular weight addition polymer or copolymer. A superior result is achieved by combining the polar oxygenated hydrocarbon and the low molecular weight addition polymer or copolymer in any proportion.

Optionally, the hydrophilic conditioner may be added. Any amount is useful; from about 5 to about 50 percent by weight of the total antigel is preferred; from about 10 to about 30 percent by weight of the total antigel is highly preferred.

Also optionally, the compatibilizing agent may be added. Any amount is useful; from about 5 to about 30 percent by weight of the total antigel is preferred; from about 10 to about 20 percent by weight of the total antigel is highly preferred.

An illustrative antigel composition of the present invention comprises 40% by weight polar oxygenated hydrocarbon, 40% by weight ethylene/vinyl acetate copolymer, 10% by weight diethylene glycol monomethyl ether, and 10% by weight of decanol-1.

In addition to the main functional components and the antigel composition of the present invention, other optional components may also be advantageously employed. Among these are biocides, antioxidants, corrosion inhibitors, viscosity index improvers, dispersants, pour point depressants, and various so-called combustion improvers. The composition of these ingredients are well known to those most skilled in the art.

The amount of antigel composition employed can vary widely depending on the type of fuel, the potential exposure to water or air (which contains water), the type and size of storage system, and the weather conditions expected. Generally the antigel is useful at about one part per 3000 parts by volume to about one part per 500 parts by volume. A more preferred level of use is about one part per 1000 parts to 2000 parts by volume.

Having described the present invention above, it is now illustrated, but not limited, by the following Examples. The scope of this disclosure is described more fully in the claims.

EXAMPLE 1

A standard test loop was built to test antigel compositions in No. 2 truck diesel fuel with a ten-micron truck filter at −18° F. (−28° C.) after 18 hours in the freezer to simulate overnight conditions.

A five-gallon (20 l.) container for diesel fuel, a Detroit Diesel 10-micron truck filter and appropriate thermometers and thermostat were connected inside an insulated freezer. A Detroit Diesel gear pump with a 0–100 psi gauge and a 110-volt 1750 rpm motor, a back-pressure control valve, and a five-gallon receiver were connected outside the freezer. When the pump was started, it created a partial vacuum on the fuel oil via the filter, thus simulating operation of a Detroit Diesel truck at 1750 rpm with its characteristic 50–70 psi back pressure. The time for five gallons to pass from the −18° F. container to the 70° F. container is a measure of viscosity and degree of wax precipitation and varied from 12 to 18 minutes. More important is whether at −18° F. five gallons of fuel plugs the 10-micron filter.

EXAMPLE 2

A stock solution of antigel composition was prepared by mixing 10 parts hexanol (EPAL-6, Ethyl Corp., Baton Rouge, LA) and 10 parts diethylene glycol monomethyl ether (UCAR, Union Carbide Corp., Danbury, CT) at ambient temperature for five minutes. To this solution was added 40 parts ethylene/vinyl acetate copolymer (ECA 7305, Exxon Corp., Linden, NJ) and mixing continued at about 65° F. for 15 minutes. Then 40 parts of a proprietary polar oxygenated hydrocarbon was added and the mixing continued for about 12 minutes more.

To five gallons of No. 2 distilled diesel fuel, summergrade (Hess) was added 1 part antigel of the preceding paragraph per 3000 parts fuel. The compounded fuel was then placed in the fuel reservoir of the apparatus of Example 1 and the temperature slowly lowered to −18° F. (−26° C.). After 17 hours (overnight) at −18° F. the apparatus was started and the five gallons of compounded fuel drawn through the 10 micron filter without any plugging.

COMPARATIVE EXAMPLE I

The experiment of Example 2 was repeated in the apparatus of Example 1 using uncompounded No. 2 diesel fuel, summergrade (Hess), at a series of temperatures starting at 40° F. and proceeding at 10° F. intervals, namely 40° F., 30° F., 20° F., and 10° F., all requiring about 12 minutes for the transfer of 5 gal. from the freezer reservoir to the ambient reservoir at 60 psi back pressure. At 0° F. 13 minutes were required. At −3° F., the 10 micron filter plugged so badly that the transfer was completely stopped after only two gallons of the five gallons had been pumped through.

EXAMPLE 3

A fleet of 92 trucks was run on diesel fuel stored in 10,000 gal. underground tanks for three years. The trucks ranged in size from 12,000 lbs. to 32,000 lbs.

Prior to the use of the antigel composition of the present invention solidification of the fuel was prevented by adding significant amounts of kerosene.

Commencing in the winter and continuing for three years, one part of antigel as in Example 2 was added per 2000 parts of fuel during the months of November to March. During this time the temperature ranged as low as −15° F. With the use of the antigel, no solidification or wax formation was observed and the fleet of trucks operated continuously without any plugging of their filters.

EXAMPLE 4

A utility company stored No. 2 oil for jet-powered generators at nine locations in a Middle Atlantic state with a total storage capacity of 7,000,000 gals. Prior to the use of the antigel composition, as in Example 2, precipitation of wax and ice was an intermittent problem from November to March each year, when these engines were used for peak demand periods.

Use of one part antigel per 2000 parts fuel oil totally prevented wax plugging of 5-micron fuel filters for three winters.

Prior to the use of the composition of the present invention, whenever the temperatures ranged below 20° F., plugging of fuel filters was a problem. With the use of the composition of the present invention, no wax plugging occurred even at 0° F.

EXAMPLE 5

A utility company employed stationary jet engines run on No. 2 fuel oil to supply electrical generating capacity during peak periods. Prior to the use of the antigel composition of the present invention so much trouble was experienced with wax plugging of the 5-micron fuel filters during winter months that straight kerosene had to be employed as the fuel at much higher expense than No. 2 fuel oil.

For one year during the winter months one part of the antigel as in Example 2 was added per 200 parts of No. 2 diesel fuel. The total amount of fuel so treated was about 50,000 bbls. (one million gallons) per year. During this time no plugging of the 5-micron fuel filters for these aircraft-type jet engines took place.

EXAMPLE 6

A certain utility employed jet engines run on No. 2 fuel oil because of the superior lubricating properties of that fuel. At temperatures below 20° F., however, severe plugging of fuel filters had occurred.

Over a three-year period with the use of 1 part of the antigel composition of the present invention per 2000 parts of No. 2 fuel oil no plugging occurred even though in one particular winter, 24 days were so cold that plugging problems would have been anticipated without its use.

Having illustrated this invention by the Examples above, the scope of protection to be granted by Letters Patent is more fully described in the following claims:

We claim:

1. An antigel composition comprising an effective phase separation preventing amount of a polar oxygenated hydrocarbon and a low molecular weight addition polymer containing ethylene moieties combined in any proportion, wherein the polar oxygenated hydrocarbon has an acid number between about 25 and about 125, a saponification number between about 30 and about 250, and an average molecular weight between about 250 and about 500, and wherein the low molecular weight addition polymer containing ethylene moieties has a molecular weight between about 500 and about 30,000.

2. The antigel of claim 1 wherein the low molecular weight addition polymer has a molecular weight between about 1,000

3. The antigel of claim 1, further comprising at least 5% by weight of a hydrophilic conditioner.

4. The antigel of claim 3, wherein the hydrophilic conditioner is selected from the group consisting of glycols, glycol monoethers, and glycol diethers.

5. The antigel of claim 1 further comprising at least 5% by weight of a compatibilizing agent having a solubility parameter between about 8.8 and about 11.5.

6. The antigel of claim 5, wherein the compatibilizing agent is an alcohol having from four to 13 carbon atoms.

7. The antigel of claim 6, wherein the alcohol is selected from the group consisting of hexanols, decanols, and dodecanols.

8. An antigel comprising the following composition weight percent:

| | Wgt % |
|---|---|
| a polar oxygenated hydrocarbon | 30–50 |
| a low molecular weight addition polymer containing ethylene moieties | 30–50 |
| a hydrophilic conditioner | 10–30 |
| a compatabilizing alcohol having from four to 13 carbon atoms | 10–20 |

wherein the polar oxygenated hydrocarbon has an acid number between about 25 and about 125, a saponification number between about 30 and about 250, and an average molecular weight between about 250 and about 500, and wherein the low molecular weight addition polymer containing ethylene moieties has a molecular weight between about 500 and about 30,000.

9. An antigel comprising the following composition by weight percent:

| | Wgt. % |
|---|---|
| a polar oxygenated hydrocarbon | 40 |
| an ethylene/vinyl acetate low molecular weight copolymer | 40 |
| diethylene glycol monomethyl ether | 10 |
| hexanol | 10 |

wherein the polar oxygenated hydrocarbon has an acid number between about 25 and about 125, a saponification number between about 30 and about 250, and an average molecular weight between about 250 and about 500, and wherein the low molecular weight copolymer containing ethylene moieties has a molecular weight between about 500 and about 30,000.

10. In combination;

a predominantly hydrocarbon liquid fuel for combustion in motors, engines, turbines, and furnaces; and an antigel composition comprising an effective phase separation preventing amount of a polar oxygenated hydrocarbon and a low molecular weight addition polymer containing ethylene moieties, combined in any proportion, wherein the polar oxygenated hydrocarbon has an acid number between about 25 and about 125, a saponification number between about 30 and about 250, and an average molecular weight between about 250 and about 500, and wherein the low molecular weight addition polymer containing ethylene moieties has a molecular weight between about 500 and about 30,000.

11. The combination of claim 10 further comprising at least 5% by weight of a hydrophilic conditioner.

12. The combination of claim 11 further comprising a hydrophilic conditioner selected from the group consisting of glycols, glycol monoethers, and glycol diethers.

13. The combination of claim 10 further comprising at least 5% by weight of a compatabilizing agent having a solubility parameter between about 8.8 and about 11.5.

14. The combination of claim 10 wherein the compatibilizer agent is an alcohol having from four to 13 carbon atoms.

* * * * *